US006770356B2

(12) United States Patent
O'Donnell et al.

(10) Patent No.: US 6,770,356 B2
(45) Date of Patent: Aug. 3, 2004

(54) FIBERS AND WEBS CAPABLE OF HIGH SPEED SOLID STATE DEFORMATION

(75) Inventors: Hugh Joseph O'Donnell, Cincinnati, OH (US); Eric Bryan Bond, Maineville, OH (US); Jody Lynn Hoying, Maineville, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 114 days.

(21) Appl. No.: 10/214,008

(22) Filed: Aug. 7, 2002

(65) Prior Publication Data

US 2003/0082360 A1 May 1, 2003

Related U.S. Application Data

(60) Provisional application No. 60/310,597, filed on Aug. 7, 2001.

(51) Int. Cl.[7] ..... B32B 27/04

(52) U.S. Cl. ..... 428/297.4; 428/515; 428/910; 156/229; 156/167; 264/290.2

(58) Field of Search ..... 428/297.4, 910, 428/515; 442/394; 156/229, 164, 167; 264/210.8, 290.2

(56) References Cited

U.S. PATENT DOCUMENTS

| | | | | |
|---|---|---|---|---|
| 4,517,714 A | | 5/1985 | Sneed et al. | |
| 4,578,307 A | | 3/1986 | Niki et al. | |
| 5,010,145 A | | 4/1991 | Ikada et al. | |
| 5,294,469 A | | 3/1994 | Suzuki et al. | |
| 5,296,289 A | | 3/1994 | Collins | |
| 5,456,696 A | | 10/1995 | Liu | |
| 5,525,706 A | | 6/1996 | Gruber et al. | |
| 5,609,808 A | | 3/1997 | Joest et al. | |
| 5,691,398 A | | 11/1997 | Tanifuji et al. | |
| 5,698,322 A | | 12/1997 | Tsai et al. | |
| 5,702,826 A | * | 12/1997 | Ehret et al. | 428/515 |
| 5,730,821 A | | 3/1998 | Joest et al. | |
| 5,783,504 A | | 7/1998 | Ehret et al. | |
| 5,807,973 A | | 9/1998 | Gruber et al. | |
| 5,833,787 A | * | 11/1998 | Ehret et al. | 156/167 |
| 5,851,937 A | * | 12/1998 | Wu et al. | 442/394 |
| 5,883,199 A | | 3/1999 | McCarthy et al. | |
| 5,910,368 A | | 6/1999 | Ehret | |
| 5,945,480 A | | 8/1999 | Wang et al. | |
| 5,958,322 A | | 9/1999 | Thompson et al. | |
| 6,114,495 A | | 9/2000 | Kolstad et al. | |
| 6,135,987 A | | 10/2000 | Tsai et al. | |

* cited by examiner

*Primary Examiner*—Merrick Dixon
(74) *Attorney, Agent, or Firm*—Leonard W. Lewis; Angela Marie Stone

(57) ABSTRACT

The present invention relates to an intermediate web comprising of high glass transition polymer fibers. The fibers are spun at low to moderate speeds and have a relative crystallinity of from 10% to 75% of the maximum achievable crystallinity. The intermediate web is a low crystallinity web that exhibits shrinkage of more than 30% and elongation to break of more than 80% at high strain rates. This web can be heat treated to reduce shrinkage to less than 15% while the web is capable of at least about 60% elongation at a strain rate of at least about 50 second$^{-1}$.

26 Claims, 3 Drawing Sheets

FIBERS AND WEBS CAPABLE OF HIGH SPEED SOLID STATE DEFORMATION

CROSS REFERENCE TO RELATED APPLICATION

This application claims the benefit of U.S. Provisional Application No. 60/310,597, filed Aug. 7, 2001.

FIELD OF THE INVENTION

The present invention relates to fibers and webs comprising high glass transition temperature polymers. The webs are capable of high speed solid state deformation processing.

BACKGROUND OF THE INVENTION

High glass transition temperature fibers and webs are commonly used in textile and commercial applications. The fibers typically have high tensile strength, high moduli, good heat resistance, and low shrinkage. High glass transition temperature fibers, such as poly(ethylene terephthalate) fibers, are used in many durable applications while biodegradable high glass transition temperature fibers, such as polylactic acid fibers, are used in both disposable and durable applications.

Typically, manufacturers of the high glass transition temperature fibers spin the fibers at high speeds or high draw ratios. High speed spinning causes high stress in the molten fibers which results in orientation and crystallization of molecules to near maximum levels. Alternatively, fibers may be spun at lower speed and then mechanically drawn at a high draw ratio to induce the high stress needed to create the orientation and crystallization. The high speed spinning or high draw ratio results in high performance fibers. The high performance fibers exhibit high strength, high modulus, low elongation to break, and low shrinkage.

A highly oriented and crystalline fiber has good heat resistance and dimension stability. The high speed or high draw ratio spinning can make the high performance fibers of fine denier. Therefore, these high performance fibers are widely used in the industrial and apparel industries. However, webs from these materials are not formable at high strain rates, such as occur in web post-processing, because the molecular deformation is fixed as illustrated by the high degree of orientation and crystallinity. The low elongation at break point limits the use of these fibers in post-processing such as solid state formation. Additionally, nonwoven webs of high performance fibers have been found to exhibit undue harshness that may be attributed to high tensile properties such as modulus.

An alternative to high speed or high draw ratio spinning where high stresses are generated is lower speed and lower draw ratio spinning where low to moderate stresses are generated. High glass transition polymers spun at these low speed and low draw ratio will have a high elongation at break point and may have a ductile amorphous phase. The high elongation enables the fibers processed under these conditions to be subjected to post-processing such as solid state formation. Although post-processing at high speed is possible with these fibers, the fibers have limited thermal stability which results in high heat shrinkage. If the processing temperature is raised above the glass transition temperature, fiber and web shrinkage of greater than 50% can result. Some heat treatment in constraining devices have been disclosed, for example, Ehret in U.S. Pat. No. 5,833,787, Iwasaki in U.S. Pat. No. 4,701,365, and Thompson in U.S. Pat. No. 5,958,322. The devices include tenter frames where biaxial stretch is applied, felt/drum constrainment, and forming wires with pins which constrain shrinkage.

Consequently, there is a need for the high elongation fibers spun at low to moderate speeds or low draw ratios to be thermally stable. It is desirable to provide a process which results in reduced shrinkage of the post-processable fibers.

It is also desirable to provide fibers and webs comprising high glass transition polymers that have a high elongation at high strain rates and are thermally stable to prevent excessive shrinkage. Moreover, the post processed webs will result in soft, flexible webs that are suitable for use in many industries.

SUMMARY OF THE INVENTION

The present invention relates to an intermediate web comprising of high glass transition polymer fibers. The fibers are spun at low to moderate speeds and have a relative crystallinity of from 10% to 75% of the maximum achievable crystallinity. The intermediate web is a low crystallinity web that exhibits shrinkage of more than 15% and elongation to break of more than 75% at high strain rates. This web can be heat treated to reduce shrinkage to about 15% or less, while the web is capable of at least about 60% elongation at a strain rate of at least about 50 second$^{-1}$. Preferred high glass transition polymers include polyethylene terephthalate, polytrimethylene terephthalate, polybutylene terephthalate, poly lactic acid, and copolymers and combinations thereof. In a preferred embodiment, the fibers are comprised of bicomponent cross sectional segments with a majority section comprised of a crystallizable high glass transition polymer. The polymer has a maximum achievable absolute crystallinity of about 15% to about 60%.

The present invention also relates to processes for manufacturing a spun bond web comprising a high glass transition temperature polymer. The process has the steps of a) spinning fibers having crystallinity of from 10% to 75% of the maximum achievable crystallinity and being capable of shrinking more than 30%, b) thermally bonding the fibers using at least one calender roll which is heated above the glass transition temperature while the fibers are constrained, and c) quenching the fibers while constrained to produce a web having a web width of greater than about 70% of the prebonded web width. It is also desired that the web is heat treated to reduce shrinkage of the web to less than about 15% and crystallinity to less than about 75% of the maximum achievable crystallinity. The heat treating can occur after constrained bonding but before the quenching step, after the quenching step, before post-processing, or during post-processing. Multiple heat treatment steps may be used. Heat treatment during or after post processing may increase crystallinity as high as desired so as to enhance properties such as thermal stability. The most preferred method is to include heat treatment during post treatment immediately prior to or during molding.

Another process of the present invention is a process for manufacturing a staple fiber web comprising a high glass transition temperature polymer. The process has the steps of: a) spinning fibers having crystallinity of from 10% to 75% of the maximum achievable crystallinity and being capable of shrinking more than about 30%, b) drawing the fiber at a mechanical draw ratio of less than about 4, c) heating and drawing the fibers at a mechanical draw ratio of from 0.8 to 1.5 at a temperatures from about the glass transition temperature to about the melting point temperature for a period of time sufficient to relax internal stress of the fiber resulting in fibers having shrinkage of less than about 15% and crystallinity to less than about 75% of the maximum achievable crystallinity; and then laying the fibers into a web and bonding the web. The process for manufacturing may further comprise post-processing the web while the web is constrained.

BRIEF DESCRIPTION OF THE DRAWINGS

These and other features, aspects and advantages of the present invention will become better understood with regard to the following description, appended claims, and accompanying drawing where:

DETAILED DESCRIPTION OF THE INVENTION AND DRAWINGS

Figure 1:
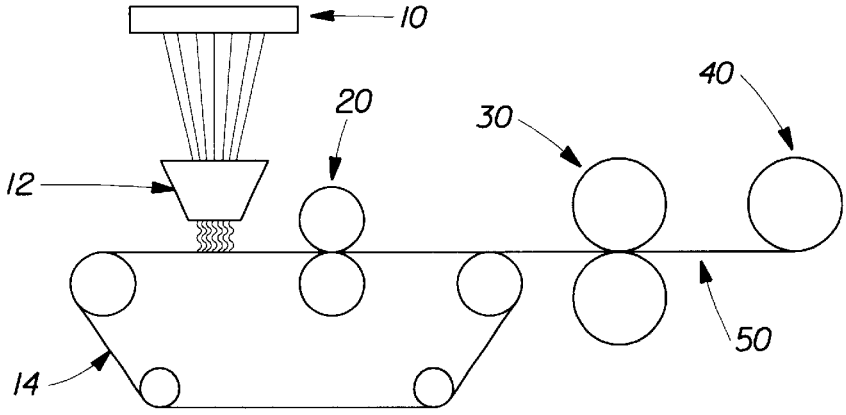
FIG. 1 is a schematic drawing illustrating a standard spun bond process.

All products, articles, compositions, methods, and processes desribed herein may comprise, consit essentially of, or consist of the required elements specified herein as well as any or all relevant optional elements desribed herein.

All patents, patent applications, and publications referenced herein are incorporated by reference in their entirety and are incorporated by reference with respect to the portions of their disclosures pertaining to the reasons for which they were cited. No admissions are made that any such references are relevant prior art.

The present invention relates to nonwoven webs comprising high glass transition temperatures polymers. The glass transition temperature hereinafter is referred to as Tg. These webs have desired solid-state deformation properties. Specifically, the webs are able to be post-processed at high strain rates due to the high elongation properties that result from low internal stress and crystallinity. Additionally, the post-processed webs can have shape retention as the shrinkage can be very low and good elasticity can be exhibited based on heat treatments. Further, the webs of the present invention can exhibit improved residual load (measured in units of force) or stress after peak load (or stress)—for example, peak load (or stress) can be compared to load (or stress) measured at a point when strain is increased by 50% above the strain at the peak load (or stress). Desirably, the load measured when the strain is 50% greater than the strain at the peak load is at least about 50% of the peak load, preferably at least about 70% of the peak load.

Although other webs are capable of being post-processed, typically the webs having polymers with low Tg do not have good shape retention or elasticity. Alternatively, webs having high Tg typically have low elongation, high crystallinity, and exhibit high stiffness and low tactility. Because of the low elongation properties, strain rate post-processing of greater than 60% strain is unlikely. Therefore, a high Tg web which is capable of both high strain rate post-processing and exhibiting shape retention and softness is desired.

The nonwoven webs are produced by spinning fibers at low to moderate speeds and low to moderate draw ratios so high levels of orientation and crystallinity are avoided. The fibers can then be heat-treated under specified conditions prior to or during solid-state deformation to render heat shrinkage to desired low levels.

For staple fiber processing, a low to moderate draw ratio is used to produce an intermediate web. An intermediate web is defined as a web that has not been heat treated. In one preference, the intermediate web is processed with a heat treating technique involving relaxation and annealing process which stabilizes the fibers prior to bonding. The heat treating technique controls the thermal stability which reduces shrinkage of the web to desired levels. For fibers produced with shrinkage of about 15% or less, standard bonding techniques may be employed to form a web. Conversely and in another embodiment, a quenched low crystallinity fiber having high shrinkage can be produced. Webs made from this type of fiber are constrained bonded, optionally constrained heat treated, and quenched. The crystallinity is typically lower than 20%.

For spun bond processing, a calender constrained quenching technique can be used. This constraining technique forces the web to maintain its dimensions after thermal bonding until constrained quenching. Webs having low crystallinity and low to moderate levels of orientation can be created. The intermediate webs may be further heat treated to relax the internal stress of the fiber or the heat treatment may occur between the constrained calender and the constrained quenching section to render heat treatment in one step. These processes result in webs from either spun bond or staple fiber production that are post processable.

The resulting webs with high elongation can also be reheated and drawn or deformed. In-line reheating of the webs enables the webs to undergo molding processes or mechanical solid-state transformation processes such as ring rolling described in U.S. Pat. No. 4,834,741, selfing as described in U.S. Pat. No. 5,518,801, consolidation as described in U.S. Pat. No. 5,914,084 and U.S. Pat. No. 5,628,097, and methods for over bonding as described in WO 01/45616 A1 published Jun. 28, 2001. Reheat solid-state transformations may also stabilize the fiber through stress-induced crystallinity and create fibers with high strength and modulus. The mechanical activation from the post processing may also enhance the softness and extensibility of the nonwoven web. The reheat process may be performed on thermally stabilized webs as described by this invention or may be performed on unstabilized webs using a constrained reheating device such as heated omega wrap roll where inlet and outlet rolls pin the web to the main roll, serpentine rolls with close spacing and/or with pinning rolls, tenter frame or other suitable device. The terms "gathered," "puckered", "corrugated," and "pleated," are used interchangeably and are used to describe the condition of a molecularly oriented web, film, fiber or filament after an web is stretched, thereby drawing the web, and subsequently relaxed or the condition of a web after having been passed through a pair of corrugating forming rolls. The terms "mold", "form", "draw" and "molecular orientation" are used interchangeably. The web is subjected to molding tension at a forming station. The forming apparatus may draw the web at selected isolated discrete areas of web, or throughout the entire web. The molding may be in either the machine direction, transverse thereto, or at an oblique angle. Drawing of the web may be accomplished according to the disclosure of U.S. Pat. No. 4,223,063, which is incorporated by reference herein. Drawing the web molecularly orients the fibers , thereby increasing the web area and resulting in a permanent elongation of the web fibers. The area of the web in segments undergoing molding should be increased by at least 20%, preferably by at least 30%, and more preferably by at least 60%. This molding process should leave the web substantially undamaged such that the appearance, fuzz resistance, and residual strength are not significantly diminished. The definition of damage does include the creation of more than ten 1 mm or larger diameter holes per 100 square mm or equivalent area and preferably less than five 1 mm or larger diameter holes per 100 square mm or equivalent area and more preferably less than two 1 mm or larger diameter holes per 100 square mm or equivalent area. All percentages, ratios and proportions used herein are by weight percent of the composition, unless otherwise specified. The specification contains a detailed description of (1) processes, (2) properties (3) materials, and (4) articles.

(1) Processes

If more than one material is used in a cross sectional segment of the fiber or in the entire fiber cross section, the first step in producing a fiber will be the compounding or mixing of materials. In the compounding step, the raw materials are combined under heat and shear to intimately mix materials. The shearing in the presence of heat will result in a homogeneous melt with proper selection of the composition. The melt is then cooled and cut into pellets for transportation and use in fiber spinning. A single screw extruder is typically used to melt resinous pellets and to pressurize the melt for feeding to the melt pump. The melt pump delivers high pressure, uniform flow rate, melt to the spin head. Within the spin head, one or more melt streams are distributed to the capillary holes within the spinnerette to provide uniform flow to each hole. If two or more melt streams are fed to the spin head, the uniform flow rate of each melt stream to each capillary hole are merged to provide various cross-sectional shapes. For two melt streams, the streams join above the spinnerette (10 in FIGS. 1–3 and 110 in FIGS. 7–8) to form a bicomponent fiber with uniform cross-section along the fiber axis. Various bicomponent cross-sections are possible including sheath core, side by side, segment pie, and islands in the sea as disclosed in Hills Inc. (W. Melbourne, Fla.) sales literature. Melt emerging from the spinnerette capillaries are formed into fine fibers by the pulling action of a force generated by devices such as mechanical rolls or high velocity air jets. The resulting fibers may be used in one of two ways. First, the finished fibers may be cut, crimped, and integrated into a discontinuous nonwoven web using means such as carding. Second, the fibers may be laid-down on a forming table (14 FIGS. 1–3) into a continuous web immediately after attenuation, typically using an air jet by or draw jet (12 FIGS. 1–3) such means as spun bonding. Either types of webs may be post-treated using techniques such as reheat ring rolling to create a soft, compression resistant fabric.

Staple Fibers

Low to moderate speed spinning with low to moderate draw ratios tend to result in fibers where full crystallinity does not occur. These fibers can exhibit an internal stress than can cause shrinkage of greater than 15%, often greater than 30%, and may be higher than 50%. This high shrinkage condition is referred to as thermally unstable. If fibers comprising homopolymer polyesters, such as PET, are spun at high speeds, absolute crystallinity of about 40% or greater typically occurs. This results in shrinkage of less than about 10% and typically less than about 5%. For the present invention, it is desired that fibers are spun at low enough speeds and draw ratios to produce fibers exhibiting absolute crystallinity of less than about 30% (or having a relative crystallinity of about 75% or less of maximum achievable crystallinity of a homopolymer during spining), preferably absolute crystallinity of from about 5% to about 30%, and more preferably from about 5% to about 20%. Webs made from these thermal unstable, lower crystallinity fibers exhibit a high capability to deform at high strain rates and may exhibit enhanced softness.

Spinning speed used is dependent on the particular high glass transition temperature polymer used, its rheological properties such as extensional viscosity, the energy generated in forming crystals, the capillary flow rate, melt and quench air temperatures, and drawing conditions. The fibers should be spun at low to moderate spinning speeds where stress induced crystallinity is not complete. The resulting fibers have moderate or partial orientation (MOY or POY). See U.S. Pat. No. 5,261,472 for additional information on fiber orientation. Either moderately or partially oriented fibers are desired. The combination of spinning speed and drawing should not cause crystallinity and orientation to approach the maximum level achieved at high spinning speeds and/or high draw ratios. At commercial flow rates of 1 gram/hole/minute, the maximum velocity to prevent stress induced crystallization is about 2,500 meters/minute for poly lactic acid and about 3,800 meters/minute for polyethylene terphthalate. The stress induced crystallization onset velocity varies with the materials, capillary flow rates, temperatures, quench conditions, draw ratios, and draw temperature. Therefore, crystallinity is the key parameter not the spinning speed.

Figure 7:
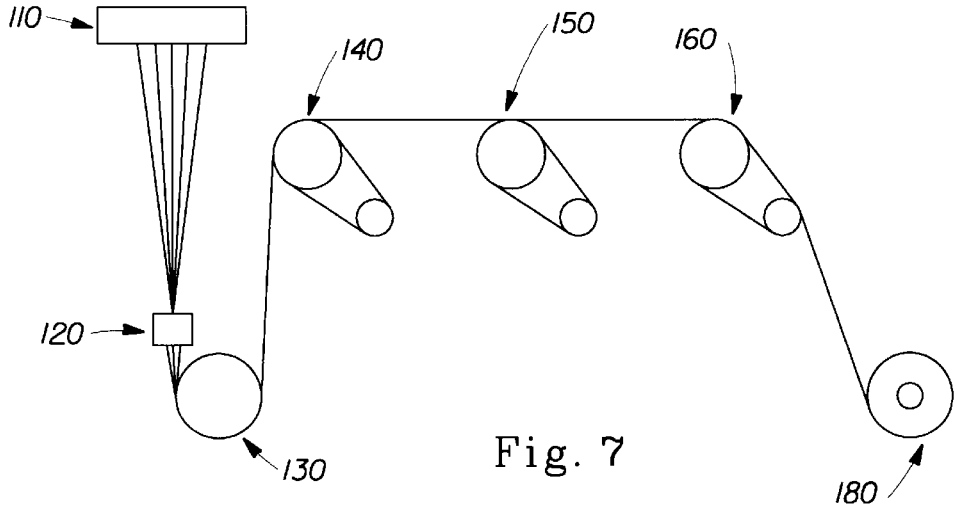
FIG. 7 is a schematic drawing illustrating a staple fiber process of the present invention.
Figure 8:
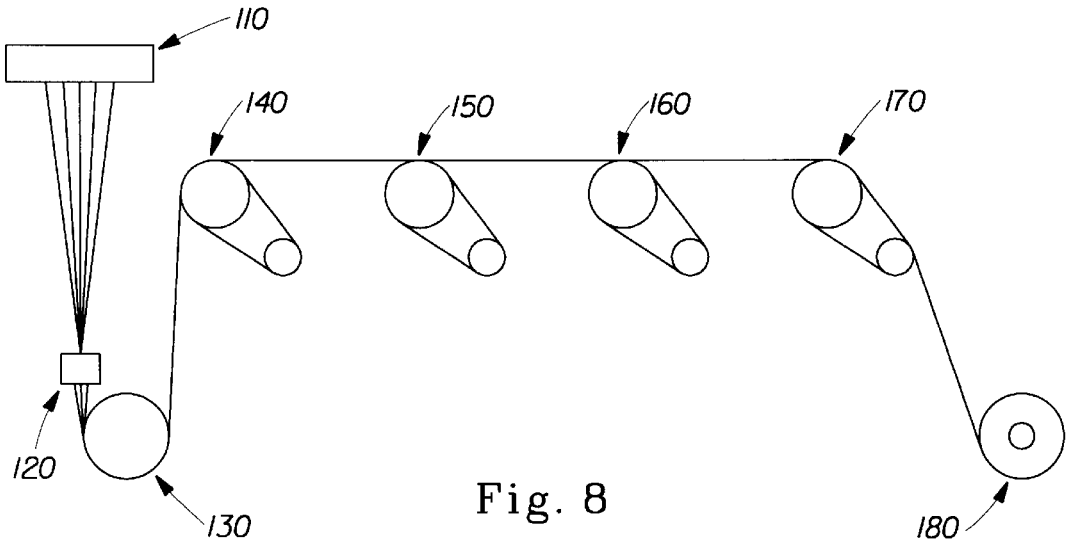
FIG. 8 is a schematic drawing illustrating a staple fiber process of the present invention.

FIGS. 7 and 8 illustrate part of the staple fiber process of the present invention. A fiber spun at low to moderate speeds through the spinnerette 110, lubricated with finish oil 120, and drawn to a low draw ratio is used. The total fiber draw ratio is defined as the ratio of the fiber at its maximum diameter squared (which is typically results immediately after exiting the capillary) to the final fiber diameter squared when collected or before being bonded. The mechanical draw ratio is defined as the ratio of the fiber diameter squared at the first roll (pull roll or feed roll 130) to the fiber diameter squared exiting the last draw roll 160 or 170. The mechanical draw ratio is less than about 4, preferably less than about 3, and more preferably less than about 2. This low draw ratio is necessary to achieve the low crystallinity and orientation required not to create a fully oriented and crystallized fiber. It may be desired that the fiber achieve its natural draw ratio as described in U.S. Pat. No. 5,261,472. This drawing step may occur under heat depending upon the material and the draw ratio needed.

The spun fibers may be thermally relaxed through heat treatment. The fiber is heated above the glass transition temperature. Preferably the fiber is heated to a temperature above Tg but below the melting point (Tm) of the fiber. The fibers may be slightly drawn during the heat treatment as the molecular structure is relaxed to minimize shrinkage. The drawing in this heat treatment step is done at a lower draw ratio than the drawing done prior to this step. This low mechanical draw ratio is typically from about 0.8 to about 1.5.

Preferably, the fiber are heated and drawn under a tension that constrains the fiber from shrinking for a time that is sufficient for relaxation of the internal stress in the amorphous phase to occur. The crystallinity increases during this relaxation stage because at the elevated temperature the molecules are mobile and can pack into crystals. The intent of heating step is to relax the internal stress while maintaining a low crystallinity.

Relaxation can be performed using multiple godets in a series (140, 150, 160, 170), with a low draw ratio maintained. The constrained annealing relaxation method may be performed in one step or in steps where the intermediate fiber is stored prior to the final treatment. A relaxation step may also be beneficial prior to each winding or storing of fiber. The relaxation step consists of allowing the fiber to shrink up to 20% prior to cooling. The shrinkage is controlled by the draw ratio of the cooling roll to the last heated roll. The relaxation prevent tight tension on wound rolls or poor unwinding. As shown in FIGS. 7 and 8, the staple fibers are drawn, relaxed and may be annealed before being wound onto a winder or tow can 180. In FIG. 7, the fiber is drawn between the first stage draw roll 140 and the send stage draw roll 150. Between the second stage draw roll 150 and the third stage draw roll 160, the fiber may be relaxed and/or annealed. In FIG. 8, the fiber is also drawn between the first stage draw roll 140 and the send stage draw roll 150. Between the second stage draw roll 150 and the third stage draw roll 160, the fiber may be relaxed and subsequently annealed between the third stage draw roll 160 and the fourth stage draw roll 170. Any number of draw rolls may be used in this process.

The time at the high temperature must be sufficient to reduce shrinkage and can be followed by immediate cooling. Preferably, the fibers is relaxed at low mechanical draw ratio of from about 0.8 to about 1.5 and at a temperature of from about Tg to about Tg+0.8(Tm−Tg). More preferably, the fiber is relaxed at a draw ratio of from about 0.9 to about 1.2 and a temperature from about Tg+10 to about Tg+0.5(Tm−Tg). Most preferably, the fiber is relaxed at a draw ratio of from about 0.95 to about 1.1.

For example, if poly(ethylene terephthalate) is used to make fiber, the spin pack melt temperature is at about 285° C. to about 305°, preferably 290° to about 300C. Fiber spinning speeds of greater than 750 meters/minute are required for poly(ethylene terphthalate). Preferably, the fiber spinning speed is from about 1,000 to about 4,000 meters/minute, more preferably from about 1,000 to about 3,000 meters/minute, and most preferably from about 1,500 to about 3,000 meters/minute. The mechanical draw ratio between feed roll (first roll) and the last roll should be less than 4. Preferably, the mechanical draw ratio should be from about 1 to about 3, more preferably from about 1.2 to 2.5. For the heat treatment process, the fiber should be relaxed from about 100° to about 180° C. at a mechanical draw ratio of 0.9 to about 1.2.

In another example, if poly(lactic acid) is used to make fibers, the spin pack melt temperature is at about 180° C. to about 240°, preferably 200° to about 230° C. Fiber spinning speeds of greater than 750 meters/minute are required. Preferably, the fiber spinning speed is from about 750 to about 3,000 meters/minute, more preferably from about 1,000 to about 2,500 meters/minute, and most preferably from about 1,000 to about 2,000 meters/minute. The draw ratio between feed roll (first roll) and the last roll should be less than 4. Preferably, the mechanical draw ratio should be from about 1 to about 3, more preferably from about 1.2 to about 2.5. The fiber should be relaxed from about 70 to 110° C. at a draw ratio of 0.9 to about 1.2.

The process should create a fiber with skin/core birefringence difference less than 20% preferably less than 10% and more preferably less than 5%. The skin/core birefringence is described in more detail in U.S. Pat. No. 4,156,071, incorporated by reference.

The resulting continuous fiber can then be crimped and cut to make nonwoven webs using methods such as carding, air laying, and wet laying processes. Bonding of the web may be though latex adhesives, powder adhesives, hydroentanglement, and other mechanical or chemical methods. Thermal bonding, such as point bonding or through air bonding, may also be used if the internal stress of the fiber has already been relaxed. Thermal bonding is the preferred method of bonding the webs.

Spun Bond Fiber Spinning

Low to moderate speed spinning generally will result in fibers where full crystallinity does not occur. Additionally, the fiber will exhibit an internal stress that can cause shrinkage of greater than 15%, possibly higher than 30% and may even be higher than 50%. The high shrinkage condition is referred to as thermally unstable. If fibers are spun at high speeds, approximately 40% or greater crystallinity and less than about 5% shrinkage can occur. These fibers are termed spun oriented fibers (SOF) as described in U.S. Pat. No. 5,261,472. For the present invention, it is desired that fibers are spun at low enough speeds to produce fibers exhibiting absolute crystallinity of about 30% or less (or having a relative crystallinity of about 75%, or less, of maximum achievable crystallinity of a homopolymer during spinning), or in alternate embodiments from about 5% to about 30%, and more preferably from about 5% to about 20%. Webs made from these lower crystallinity fibers that exhibit thermal shrinkage of greater than 15% and even greater than 30% can exhibit a high capability to deform at high speeds and may exhibit enhanced softness.

Spinning speed is dependent on the particular high glass transition temperature polymer used its theological properties such as extensional viscosity, the energy generated in forming crystals, the capillary flow rate, and melt and quench air temperatures. The fibers should be spun at low to moderate spinning speeds where stress induced crystallinity is beginning or has reached an intermediate level. The speed should not cause crystallinity and orientation to approach the maximum level achieved at high spinning speeds. At commercial flow rates of 1 gram/hole/minute, the maximum velocity to prevent stress induced crystallization is about 2,500 meters/minute for poly lactic acid and about 3,800 meters/minute for polyethylene terphthalate. The stress induced crystallization onset velocity varies with the materials, capillary flow rates, temperatures, and quench conditions, draw ratios, and draw temperature. For example, if poly(ethylene terephthalate) is used to make fiber, the spin pack melt temperature will be about 285° C. to about 305°, preferably 290° to about 300° C. Fiber spinning speeds of greater than 1,500 meters/minute are required. Preferably, the fiber spinning speed is from about 2,000 to about 5,000 meters/minute, more preferably from about 2,500 to about 4,500 meters/minute, and most preferably from about 3,000 to about 4,000 meters/minute. For poly(lactic acid), the spin pack temperature will be about 180° C. to about 240° C., preferably 200° C. to about 230° C. Fiber spinning speeds of greater than 800 meters/minute are required. Preferably, the fiber spinning speed is from about 1,000 to about 4,000 meters/minute, more preferably from about 1,000 to about 3,500 meters/minute, and most preferably from about 1,500 to about 3,000 meters/minute.

The process should create a fiber with skin/core birefringence difference less than 20% preferably less than 10% and more preferably less than 5%. The skin/core birefringence is described in more detail in U.S. Pat. No. 4,156,071.

Figure 2:
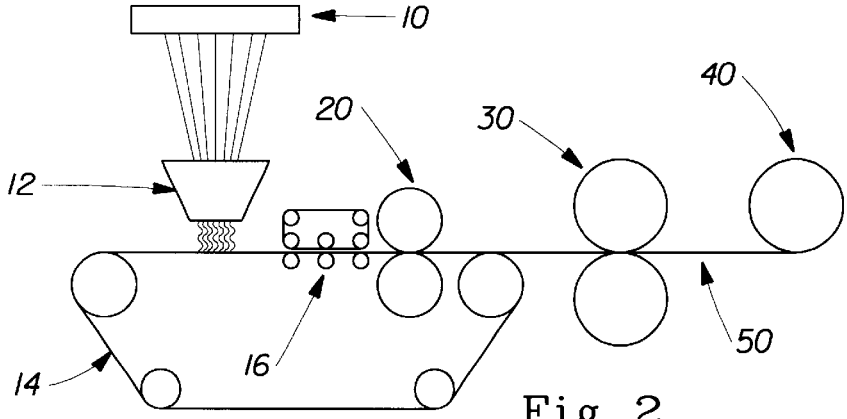
FIG. 2 is a schematic drawing illustrating a spun bond process with the constraining step of the present invention illustrated.
Figure 3:
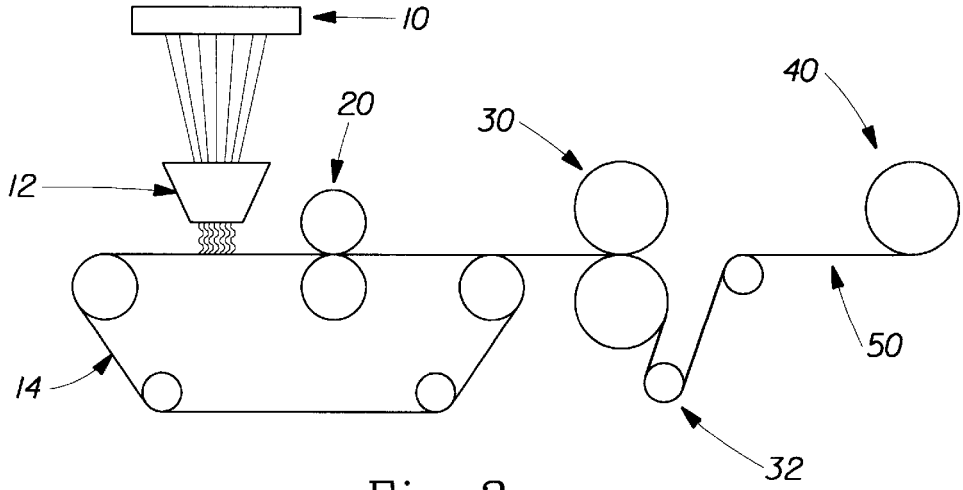
FIG. 3 is a schematic drawing illustrating a spun bond process with the constraining step of the present invention illustrated.

FIG. 1 provides a schematic drawing of a standard spun bond process and FIGS. 2 and 3 provide a schematic drawing of the spun bond process of the present invention. As seen in all three figures, the fibers are produced by the spinnerette 10 and draw jet 12. The fibers are then located on a forming table 14 and proceed to a compaction roll 20.

Nonwoven Web Formation from Staple Fibers

The fibers with low crystallinity and orientation may be formed into a web and bonded. Bonding may occur by latex, hydroentanglement, powder bonding, or other known mechanical bonding methods or with thermal bonding methods. The resulting web will exhibit the greatest ability to be deformed because the crystallinity is minimized and the bonding may be flexible such as when elastomeric bonding compounds are used. The staple fibers may still have some degree of internal stress which is not suppressed by high crystallinity. If the internal stress remains, the webs may undergo greater than 15% and even greater than 30% shrinkage if subjected to temperatures above the glass transition temperature.

The relaxation of internal stress can reduce shrinkage and is preferably performed at elevated temperatures while the fiber or web is constrained from shrinking. This method of relaxation of the internal stress at elevated temperatures with the web constrained is referred to as constrained annealed relaxation method. This method permits stress to be relieved without significant increase in the fiber diameter or significant shrinkage of the web width. The annealing occurs simultaneously with the relaxation and increases the crystallinity. The intent is to relax the internal stress without a significant increase in crystallinity. The heat treatment should not induce a level, size or connectivity of crystallinity that severely limits molecular motion within the fiber. The constraining of the fiber during the constrained annealing relaxation process maintains a small fiber diameter and the web width so that the basis weight is controllable and uniform. The web resulting from the constrained annealed method will have width reduction of 20% or less, preferably 15% or less, more preferably 10% or less, and most preferably 5% or less.

A constrained bonding quenching method can be applied to thermally unstable webs that are bonded with methods such as thermal point bonding. This technique minimizes area and fiber shrinkage during bonding at temperatures above Tg. These webs may be relaxed and thermally stabilized in thermal treatment in-line or in secondary operations. The relaxation step reduces internal stress throughout the fiber cross-section and potentially reducing any skin/core internal stress variation.

For staple fibers that have been constrained relaxed during fiber production, the webs can be thermally bonded without the need for constrained bonding. The constrained bonding may however, be useful if fiber or web shrinkage of greater than 10% exists.

Spun Bond Webs

The spun bond webs may be made by constraining, annealing, and relaxing the internal stress of the web before bonding and/or after bonding. It has been found that unstable fibers can be thermally bonded to produce an amorphous or low crystallinity web with little equipment modification. The fibers are constrained during bonding and until the fibers are quenched using roll constrainment. A heat treatment of the constrained web to stabilize the fibers may occur either after bonding, after quenching, just before or during post-processing. In the latter cases, the spun bond webs may first be bonded and then immediately constrained and quenched. In this process, rapid constrainment following bonding occurs to prevent significant shrinkage while the web is hot and quenching occurs prior to the release of the constraint. An amorphous or low crystallinity web is produced. Subsequent heat treatment can be used to relax the internal stress that creates the potential for shrinkage. It is desired to reduce shrinkage while only minimally increasing crystallinity. The heat treatment should not induce a level, size or connectivity of crystallinity that severely limits molecular motion within the fiber.

The spun bond webs can be processed on standard equipment with little equipment modification. The low crystallinity and oriented fibers are bonded in a heated calender 30 where the engraved roll (top roll) is heated to bonding temperatures. The temperature of the engraved calender roll 30 may be higher than the typical bonding temperatures to offset potentially lower anvil roll temperatures. The temperature of the anvil roll is typically cooler than standard bonding temperatures. Preferably, the anvil roll temperature is at least 10 degree C., and more preferably at least 30 degree C., lower than the typical bonding temperature. For creating the lowest crystallinity webs, it is preferable that the temperature of the anvil roll be as low as or lower than the fiber's Tg or heat distortion temperature. Through the use of constraining devices, 16 in FIG. 2 or 32 in FIG. 3, such as rollers, the web is forced to follow the anvil roll over a portion of the circumference (called a partial wrap angle) which constrains the width of the web. The web is constrained against the colder anvil roll for at least a 5 degree wrap angle, preferably a 10 degree to about 200 degree wrap angle, and more preferably a 30 to 180 degree wrap angle The anvil roll temperature and wrap angle should be selected to decrease shrinkage to desired levels, quench the web, and create sufficient bond strength. Cool air may also be blown on the surface of the constrained web to aide in quenching.

If the anvil temperature is below the glass transition temperature and the residence time of the cool anvil roll is sufficient, a quenched wide web is produced. The residence time on the cool roll is preferably sufficient to freeze the fibers after bonding and before significant shrinkage of the web can occur. The combination of a cool anvil roll, constraining device, and web tension restricts the web from shrinking in both the cross and machine directions. This method maintains the web area to nearly the prebonded web area and minimizes any thickening of the fiber during heating.

In an alternative method, the anvil temperature may be higher than the glass transition temperature. By using a anvil roll temperature higher than the glass transition temperature to as high as about Tg+0.8(Tm−Tg), improved bond strength may be obtained. When the web is forced to partially wrap on the hot anvil annealing roll for example by using an outlet pinning roll or closely spaced adjacent roll, the web is constrained from shrinking and the internal stress is partially or fully relaxed. This results in higher bond strengths. With this method, the web must then quickly pass from the constraining anvil roll to another constraining rollThis second constraining roll is typically a quench roll where the temperature is below the heat distortion temperature and/or Tg and it is located so that only a small free-span between rollers exists.

The free-span is controlled by suitable design of equipment. For example, a web following a serpentine path tends to minimize the web free-span. This web path reduces the free-span relative to the web path when exiting the top position of a roll and proceeding on a horizontal path to the next constraining device that clears the forward area of the same roll. For example, the free-span between 36 inch (91.4 cm) diameter rolls that are placed 38 inches (96.5 cm) apart from center to center is 12.2 inches (31.0 cm). However, the free-span between the top position of a 36 inch (91.4 cm) diameter roll and spot located horizontal to the top roll position and two inches beyond the forward vertically tangent edge of the roll is 20 inches (53.3 cm). Thus, the roll to roll transfer of the web minimizes the free-span. Smaller diameter rolls can miminize free-span further. More importantly, closer spacing between rolls can mimimize free-span. For instance, the free-span between 36 inch (91.4 cm) diameter rolls is reduced from 12.2 (31.0 cm) to 8.5 inches (21.6 cm) when the gap between rolls is reduced from 2 inches (5.1 cm) to 1 inch (2.5 cm). he free span should be less than fifteen inches (38.1 cm), preferably less than about twelve inches (30.5 cm), more preferably less than about eight inches (20.3 cm), and most preferably the free-span is less than about five inches (12.7 cm) by close placement of the rollers and suitable selection of roller diametersHigher free spans may be tolerated as the line speed increases. As the line speed varies, the equipment should be designed to accommodate the slowest speed of practical interest as the web free-span transit time should be kept small because the web responds quickly to unconstrained conditions. This response time varies with the polymer and spinning condition. Based on manufacture of webs at 90 m/min, the free-span transit time should be less than 250 milli-seconds, preferably less than 200 milli-seconds, more preferably less than 135 milli-seconds, and less than 85 milli-seconds. In another method, the roll configuration is such that a heat treatment roll is placed between the anvil roll and the quenching constraining roll. In this configuration, the web is constrained on the anvil roll by the heat treatment roll and a small free span exists between rolls.

Figure 4:
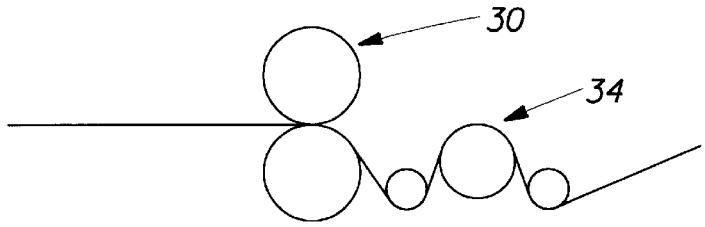
FIG. 4 is a schematic drawing detailing the constraining step in the spun bond process.
Figure 5:
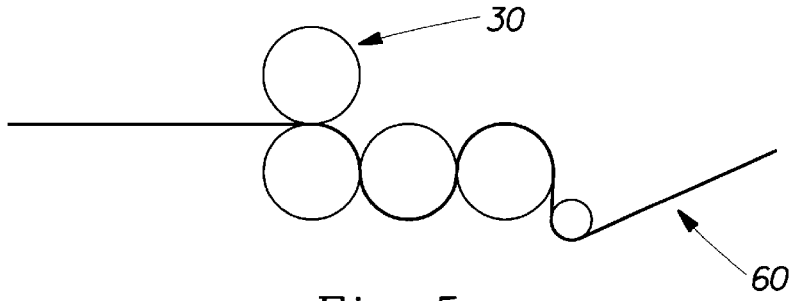
FIG. 5 is a schematic drawing detailing the constraining step in the spun bond process.
Figure 6:
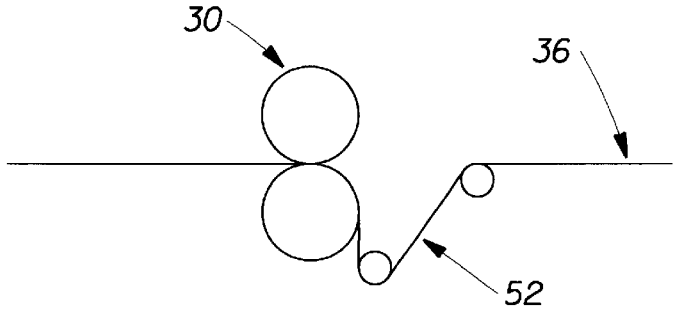
FIG. 6 is a schematic drawing detailing the constraining step in the spun bond process.

This constrained annealing process may be performed with any suitable configuration of constrained heated and quenching rolls (see FIGS. 4 and 5) or other configurations such as tenter frames (see FIG. 6). FIG. 5 illustrates a constrained bonding with post quenching technique. As shown, the web is processed through calender rolls 30 and then proceeds to the quench roll 34. The temperature of the calender rolls 30 is higher than the quench roll 34. The temperature of the quench roll 34 is lower than the Tg of the high glass temperature polymer. FIG. 6 illustrates a three roll stack configuration for heat treatment and quenching, if needed. The calender rolls 30 are typically of a higher temperature than the subsequent rolls. The last rolls is preferably at the lowest temperature. The resulting heat treated web 60 is produced. FIG. 6 illustrates a calender roll 30 with the lower roll having a lower temperature for quenching the web 52. The quenched web proceeds through the tenter frame 36 for heat treatment. The means of heating can include any conduction, convection, or radiation means. Conduction or radiation mechanism (e.g. infrared lamps) are preferred.

The temperature and time involved in the constrained annealed relaxation process will vary depending upon subsequent process steps and end-use applications. In general, the temperature of the web or fibers should be raised above the Tg and below the Tm to activate rubbery flow in the amorphous phase of the polymeric fiber. The higher the temperature of the web, the lower the viscosity of the amorphous phase and the quicker the internal stress is relieved, therefore minimizing the process time. As the temperature is raised close to the Tm, the fibers may become very weak leading to distortion of the web. To avoid this distortion, it is preferred to anneal the fibers at a temperature of from about Tg to about Tg+0.8(Tm−Tg)° C. More preferably, the temperature range is from about Tg+10 to about Tg+0.6(Tm−Tg)° C. While the time of annealing/relaxation can vary widely depending upon heat transfer mechanism (e.g. conduction, convection, or radiation), temperatures, fiber diameters, and web basis weight, heat treatment should be accomplished in less than 20 seconds, and preferably from about 0.1 to about 5 seconds, and more preferably from about 0.1 to about 2 seconds.

As shown in FIGS. 1–3, the bonded web 50 is then wound on a winding roll 40. The web 50 may then be post-processed.

Post-Processing/Mechanical Activation

These resulting webs may be subsequently heat treated to further relax the internal stress of the fiber if it is not fully relaxed. Reheating during post-treatment may also be necessary to make the webs more ductile for high speed post-processing; for example, poly lactic acid webs are known to be brittle at room temperature, but can flow when the temperature is above Tg and low crystallinity exists. However, the heat treatment must not induce a level, size or connectivity of crystallinity that severely limits molecular motion within the fiber. The state of the fiber and web that is thermally stable yet able to be reheated and drawn at high speeds is defined by the degree of crystallinity, crystal size, the long period between crystalline structures, birefringence, birefringence difference between skin and core of the fiber, and orientation of the amorphous and crystalline phases.

High speed elongational post-processing may be conducted at temperatures above the Tg of the material. This reheat temperature is preferably from about Tg+10 to about Tg+0.8(Tm−Tg). More preferably, the temperature is from about Tg+10 to about Tg+0.6(Tm−Tg). The substantial molecular deformation that occurs during elongation may be created in three-dimensions using mating grooved roller devices such as ring rolls or selfing rolls. The deformation and temperature should be suitable to cause the fibers to undergo stress-induced crystallization if a stabilized web is desired. The increased crystallinity improves the fiber tensile strength and reduces thermal shrinkage to 15% or less, preferably less than about 10%, and more preferably less than about 5%. Preferably the web is constrained during the post-processing to prevent potential shrinkage.

High speed elongational post-processing may also be conducted below Tg for low crystallinity polymers that have a ductile amorphous phase. Absolute crystallinity for such polymers is generally 20% or less, preferably about 10% or less, and more preferably about 5% or less. A ductile amorphous phase is provided when a polymer with low crystallinity can be drawn at least 50% at a strain rate that is at least 10 $s^{-1}$. A ductile amorphous phase can be predicted. While not wishing to be held to theory, the following information is disclosed in the literature by S. Wu, Polym. Int'l, 29, 229 (1992). The density of molecular entanglements determines the ductility or brittleness of a glassy polymer. In general, an entanglement density of 0.1 mmol/cc or greater indicates that the polymer behaves in a ductile manner. For a polymer with a higher entanglement density, the stress is shared among many molecules and the polymer deforms in a ductile manner. Conversely, for a polymer with a lower entanglement density, the stress is shared by few molecules and the polymer fails in a brittle manner. For high speed processing (rates of 50/sec. Or faster rates), the critical entanglement density for ductile behavior can be higher—generally from about 0.3 to about 0.5 mmol/cc. For PET, the entanglement density is 1.1 mmol/cc and low crystallinity PET can be deformed at high strain rates at room temperature. Conversely, for PLA (polylactic acid), the entanglement density is 0.13 mmol/cc and low crystallinity PLA fails in a brittle manner at room temperature. While low crystallinity fibers with high entanglement densities can be post-processed at high strain rates at room temperature, thermal stability and enhanced tensile properties are generally obtained by heat treatment above Tg as described herein.

The quenched low crystallinity webs or the heat treated, low internal stress webs can exhibit higher elongation than webs made from high speed or high draw ratio spun stress-induced crystallized fibers. The webs of the present invention can also be reheated and drawn or post-processed at 60% or greater strains at strain rates of 10 $s^{-1}$, preferably 50 $s^{-1}$, and more preferably 100 $s^{-1}$, or even greater strain rates The strains in post-processing treatment are preferably 75% or greater and more preferably 100% or greater. The resulting webs should appear homogeneous and uncut. Contrarily, post-treated webs made from high performance fibers typically tear and exhibit many broken filaments or bonds. Reheating of these webs enables the webs to undergo mechanical solid-state transformation processes such as ring rolling and selfing. Solid-state transformations may also stabilize the fiber through stress-induced crystallinity and create fibers with higher strength and modulus than the original material. The mechanical activation of the post-treatment may enhance the softness, hand, drape, loft, and extensibility of the nonwoven web.

An additional feature may be shape memory in the activated web. Since the web can be activated at temperatures above its Tg and immediately cooled to below this temperatures, it is possible that the web may retain the shape of the ring roll or other patterns if sufficient crystallinity is created. Likewise, the web can revert back to its original shape (memory) if low crystallinity exists.

Heat treating of the web or resulting article can occur after post-processing. This final heat treating step can be used to shrink certain materials such as materials not heat treated before or during post-processing.

A laminate as used herein means a sheet or web formed by the layering and bonding of two or more webs. Bonding may be performed using methods such as adhesive bonding or thermal bonding (including but not limited to thermal point bonding), or otherwise intimately jointed (including but not limited to entanglement between fibers of adjoining layers).

(2) Properties

The fibers and webs of the present invention are capable of at least about 60% elongation at strain rate of 50 $s^{-1}$. The high elongation potential enables the fibers and webs to be subject to high speed post-processing. Preferably, the fibers and webs are capable of at least about 75% elongation and more preferably at least about 100%. The percent elongation is measured under a strain rate of 50 $s^{-1}$. The strain rate used to measure percent elongation may be greater than 50 $s^{-1}$, such as at 100 $s^{-1}$, 150 $s^{-1}$, or 200 $s^{-1}$. The strain rate in post-processing may be greater than about 200 $s^{-1}$. The percent elongation is measured by placing a 10 mm sample in MTS 810 High Speed Tensile Frame (MTS Systems Corporation, Eden Prarie, Minn., USA) where the clamping jaws can travel up to 6 m/s. The MTS810 is programmed to travel from about 0.1 to about 2.4 m/s for a 10 to 50 mm travel as required for the strain rate and strain required. The deformed sample is examined and the percentage of intact fibers is counted. About six samples for each fibrous material are tested. For tests under heated conditions, a hot air gun is adjusted to temperature (e.g. from about 90 to about 160° C.) and applied to the sample from a 2 inch distance. A diffuser screen having a 100 mesh wire density is placed one inch from the sample.

After final treatment, the resulting fibers and webs of the present invention will have a web width shrinkage of about 30%, or less, of the total prebonded web width. The percent shrinkage is measured as the change in web dimensions before and after immersion in 85° C. water for 60 seconds divided by the original web dimensions. The dimensions are measured on a flat surface with a ruler at room temperature. Preferably, the web width shrinkage is about 15% or less, more preferably about 10% or less, and most preferably about 5% or less of the total prebonded web width.

Web shrinkage can be determined as follows: a 20 cm by 20 cm square section of web is provided. Lines are drawn on one surface of the web to provide a square shape having outer boundaries approximately 2.5 cm inside the edge of the web section. The length of each of the four lines of the square is measured and recorded. The web section is immersed in boiling water for two minutes, removed, and then place on a paper towel without stretching and blot lightly with a second paper towel. Smaller sections of web may be used and adjusts made proportionally to provide equivalent results if the specified size section of web is not available. The length of each of the four lines is then measured and recorded. The lengths of each set of parallel lines (one set typically being machind direction (MD) and the othe set being cross direction (CD) are averaged. Calculate percent shrinkage for CD and MD as follows: [(Average length pre-immersion)−(Average length post-immersion)/(Average length pre-immersion)]×100. For purposes of describing web shrinkage values of, and ranges and/or limits for, the webs of the present invention, CD shrinkage is used unless otherwise specifically indicated.

Fiber shrinkage can be determined as follows: a bundle of ten (10) fibers of from about 10 cm to about 15 cm in length is taped at both ends. The distance between the tape at each end is measured and recorded ($I_0$). The bundle is immersed in boiling water for 30 seconds. The bundle is removed and the distance between the tape at each end is immediately measured and recorded ($I_1$). The persent shrinkage is calculated as $[(I_0-I_1)/I_0]\times 100$.

The precursor fibers and webs of the present invention will desirably either have i) low crystallinity or ii) moderate crystallinity and low internal stress as exhibited by low shrinkage. The relative crystallinity should be about 75%, or less, of the maximum achievable crystallinity obtainable. Preferably, the relative crystallinity is from about 5% to about 60%, more preferably from about 10% to about 60%, and most preferably from about 15 to about 50% of the maximum achievable crystallinity. For many polyester fibers, the maximum achievable absolute crystallinity is about 60%, or less, and typically no more than about 40%. For a copolymer such as a 50/50 ratio of D to L stereoisomers in—PLA, the maximum achievable crystallinity obtainable is 0. Post treatment of these fibers results in weak residual tensile properties. Hence, a minimum level of achievable absolute crystallinity of about 15% is desired. For copolymers, the relative crystallinity should be calculated from the maximum achievable crystallinity based on the homopolymer made from the dominate monomer in the copolymer. For multicomponent fibers, the major component must be crystallizable and meet the above crystallinity limits while the minor component may be amorphous The fibers and webs of the present invention may have a 1% secant modulus of about 3Gpa or greater, preferably about 4GPa or greater, and more preferably about 4.5Gpa or greater, and preferably no greater than 7 GPa. Secant modulus is measured using an Instron following a procedure described by ASTM standard D 3822-91 or an equivalent test.

The fibers and webs of the present invention are not brittle and have a toughness of greater than 2MPa at post processing temperatures. Toughness is defined as the area under the stress-strain curve where the specimen gauge length is 25 mm with a strain rate of 50 mm per minute. Elasticity or extension of the fibers may also be desired.

Preferably, the fiber will have a diameter of less than 200 micrometers. More preferably the fiber diameter will be about 100 micrometer or less, even more preferably 50 micrometers or less, and most preferably less than 30 micrometers. Fibers commonly used to make nonwovens will have a diameter of from about 5 micrometers to about 30 micrometers. Fiber diameter is controlled by capillary diameter, take-up speed, mass through-put, and blend composition.

The nonwoven products produced from the fibers will also exhibit certain mechanical properties, particularly, strength, flexibility, softness, and absorbency. Measures of strength include dry and/or wet tensile strength. Flexibility is related to stiffness and can attribute to softness. Softness is generally described as a physiologically perceived attribute which is related to both flexibility and texture.

The fibers and webs containing a biodegradable polymer, such as polylactic acid, may be environmentally degradable. "Environmentally degradable" is defined as being biodegradable, disintigratable, dispersible, flushable, or compostable or a combination thereof. As a result, the fibers and webs that are environmentally degradable can be easily and safely disposed of either in existing composting facilities or may be flushable and can be safely flushed down the drain without detrimental consequences to existing sewage infrastructure systems. The environmental degradability of the fibers and webs offer a solution to the problem of accumulation of such materials in the environment following their use in disposable articles. The flushability of the fibers and webs when used in disposable products, such as wipes and feminine hygiene items, offer additional convenience and discreteness to the consumer.

(3) Materials

A stress induced crystallizeable polymer with a high Tg is used in the present invention. The Tg will be greater about 35° C. or greater, preferably from about 40° C. to about 130° C., more preferably from about 50° C. to about 120° C. The material must be capable of being crystallized when put under stress. Homopolymers and copolymers may be used as long as achievable absolute crystallinity upon stress induced crystallization during reheat drawing is at least 5%, preferably, at least 10%, and more preferably at least 15%. The absolute percentage of crystallinity may be calculated using predictions for 100% crystallinity. For example, the density of amorphous and 100% crystalline poly(ethylene terephthalate) is 1.335 and 1.455 g/cc, respectively as reported in Polymer Handbook, $2^{nd}$ Ed, J. Brandrup, E. H. Immergut, Eds., Wiley Interscience, New York, N.Y. 1975, Chp V. Alternatively, the percent crystallinity can be calculated using 122.0 J/g as the enthalpy of fusion of 100% crystalline poly(ethylene terephthalate) as reported in Physical Properties of Polymers Handbook, J. E. Mark, AIP Press, Woodbury, N.Y. 1996. The enthalpy of fusion for 100% crystalline PLA is 93.0 J/g as reported by K. Mezghani and J. E. Spruiell, J. Polym. Sci., B: Polym. Phys., 36, 1005 (1998).

The maximum achievable crystallinity is defined as the crystallinity obtainable during thermoplastic processing such as high speed spinning or fiber spin, draw, and anneal processing. The percent relative crystallinity of the polymer is the percent of crystallinity actually obtained relative to the maximum achievable crystallinity obtained for the homopolymer in the most favorable thermoplastic process, such as high speed spinning. For example, for a fiber containing D-L polylactic acid having 3 mol % of the D sterioisomer, the enthalpy of fusion is measured at 20 Joules/gram. For a fiber containing L-polylactic acid spun at high speeds, the heat of fusion is 37 Joules/gram. To calculate the relative crystallinity obtainable, this heat of fusion of the D-L polylactic acid fiber (20 Joules/gram) is divided by the heat of fusion of the homopolymer (37 Joules/gram), which is the L-polylactic acid fiber. This results in a relative crystallinity of 54%. To calculate the absolute crystallinity obtainable, the enthalpy of fusion of the D-L polylactic acid fiber (20 Joules/gram) is divided by the enthalpy of fusion for 100% crystalline homopolymer (93 Joules/gram). This results in a absolute crystallinity of 22%.

Determination of percent crystallinity is preferentially performed via X-Ray techniques such as discussed in EP 1057915. In particular, weight % crystallinity can be measured as follows: A filament sample is powdered and filled in an AL sample holder (20×18×0.5 mm). The sample holder is vertically held, and a Cu—K $\alpha$-ray is generated by means of a RAD-rB type X-ray generator (such as available from Rigaku Denki Co., Ltd., or an equivalent) and directed toward the sample perpendicularly thereto. A curved graphite monochromater is used as a light receiving device. The scan is made on a sample in the range of $2\theta$=5 to 125°, and the crystallization degree is determined from the measurements on a weight percentage basis through the Ruland method.

The polymers for use in the present invention include polyesters, polyamides, and combinations thereof. Suitable polyesters include polyethylene terephthalate, polyethylene naphthalate, polytrimethylene terephthalate, polybutylene terphthalate, polylactic acid and copolymers, and combination thereof. Suitable polyamides such as Nylon 6, Nylon 6,6, and Nylon 6,10. Preferably, the polymer will exhibit potential crystallinity of at least about 20% and ductility in the amorphous phase. Polymers formed with comonomers that reduce crystallinity are also suitable as long as at least 5%, preferably at least 10%, more preferably at leastl5% crystallinity relative to that of the homopolymer can be obtained during high speed spinning or drawing. Suitable copolymers include lactic acid polymers including lactic acid homopolymers and lactic acid copolymers; lactide polymers including lactide homopolymers and lactide copolymers; glycolide polymers including glycolide homopolymers and glycolide copolymers; and mixtures thereof. Suitable copolymers for PET include ethylene terephthalate and cyclohexylene dimethylene terephthalate.

Preferred materials of the present invention are polyethylene terephthalate, including homopolymers and copolymers of polyethylene terephthalate, and poly lactic acid, particularly the L—lactic acid stereoisomer.

Specific examples of preferred lactic acid polymers and lactide polymers suitable for use herein include, but are not limited to, those polylactic acid-based polymers and polylactide-based polymers that are generally referred to in the industry as "PLA". Therefore, the terms "polylactic acid", "polylactide" and "PLA" are used interchangeably to include homopolymers and copolymers of lactic acid and lactide based on polymer characterization of the polymers being formed from a specific monomer or the polymers being comprised of the smallest repeating monomer units. In other words, polylatide is a dimeric ester of lactic acid and can be formed to contain small repeating monomer units of lactic acid (actually residues of lactic acid) or be manufactured by polymerization of a lactide monomer, resulting in polylatide being referred to both as a lactic acid residue containing polymer and as a lactide residue containing polymer. It should be understood, however, that the terms "polylactic acid", "polylactide", and "PLA" are not intended to be limiting with respect to the manner in which the polymer is formed.

The polylactic acid polymers generally have a lactic acid residue repeating monomer unit that conforms to the following formula:

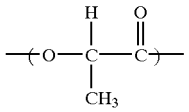

The polylactide polymers generally having lactic acid residue repeating monomer units as described herein-above, or lactide residue repeating monomer units that conform to the following formula:

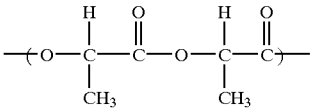

Typically, polymerization of lactic acid and lactide will result in polymers comprising at least about 50% by weight of lactic acid residue repeating units, lactide residue repeating units, or combinations thereof. These lactic acid and lactide polymers include homopolymers and copolymers such as random and/or block copolymers of lactic acid and/or lactide. The lactic acid residue repeating monomer units can be obtained from L-lactic acid and D-lactic acid. The lactide residue repeating monomer units can be obtained from L-lactide, D-lactide, and meso-lactide.

Suitable lactic acid and lactide polymers include those homopolymers and copolymers of lactic acid and/or lactide which have a weight average molecular weight generally ranging from about 10,000 g/mol to about 600,000 g/mol, preferably from about 30,000 g/mol to about 400,000 g/mol, more preferably from about 50,000 g/mol to about 200,000 g/mol. An example of commercially available polylactic acid polymers include a variety of polylactic acids, such as L9000, that are available from Biomer located at Forst-Kasten-Str. in Germany. Examples of suitable commercially available polylactic acid is NATUREWORKS from Cargill Dow and LACEA from Mitsui Chemical.

Depending upon the specific high Tg polymer used, the process, and the final use of the fiber, more than one polymer may be desired. The fibers may be formed from a single high Tg polymer described above or a blend of polymers. Alternatively, one of the above polymers may be combined with a polyolefin or other polymer as long as the fiber is capable of at least about 10% crystallization. Typically, the amount of polymer other than the high Tg polymer will be 40% or less, preferably 30% or less and commonly 20% or less.

Suitable polymers for use with the high Tg polymer in a multiconstituent fiber include biodegradable thermoplastic polymers. Nonlimiting examples of biodegradable thermoplastic polymers suitable for use in the present invention include aliphatic polyesteramides; diacids/diols aliphatic polyesters; modified aromatic polyesters including modified polyethylene terephtalates, modified polybutylene terephtalates; aliphatic/aromatic copolyesters; polycaprolactones; poly(3-hydroxyalkanoates) including poly(3-hydroxybutyrates), poly(3-hydroxyhexanoates, and poly(3-hydroxyvalerates); poly(3-hydroxyalkanoates) copolymers, poly(hydroxybutyrate-cohydroxyvalerate), poly (hydroxybutyrate-co-hexanoate) or other higher poly (hydroxybutyrate-coalkanoates) as references in U.S. Pat. No. 5,498,692 to Noda, herein incorporated by reference; polyesters and polyurethanes derived from aliphatic polyols (i.e., dialkanoyl polymers); polyamides; lactide polymers including lactide homopolymers and lactide copolymers; glycolide polymers including glycolide homopolymers and glycolide copolymers; polyethylene/vinyl alcohol copolymers; and mixtures thereof.

Other commonly used thermoplastic polymers suitable as minor components in a multiconstituent fiber of the present invention include polypropylene and copolymers of polypropylene, polyethylene and copolymers of polyethylene, polyamides and copolymers of polyamides, polyesters and copolymers of polyesters, and mixtures thereof. These materials may be either semicrystalline or amorphous.

The fibers may be in many different configurations. Constituent, as used herein, is defined as meaning the chemical species of matter or the material. Fibers may be monocomponent or multicomponent in configuration. Component, as used herein, is defined as a separate part of the fiber that has a spatial relationship to another part of the fiber. Multicomponent fibers, commonly a bicomponent fiber, may be in a side-by-side, sheath-core, segmented pie, ribbon, or islands-in-the-sea configuration. The sheath may be continuous or non-continuous around the core. The ratio of the weight of the two components is from about 5:95 to about 95:5. The fibers of the present invention may have different geometries that include round, elliptical, star shaped, trilobal, rectangular, and other various eccentricities. The fibers of the present invention may also be splittable fibers. Splitting may occur by rheological differences in the polymers or splitting may occur by a mechanical means and/or by fluid induced distortion. Low crystallinity or amorphous components may be used if in the minority of the fiber cross section.

If a fiber or web with more than one polymer is used and it is desired to have all components of the fiber deformable, the conditions suitable for the material most difficult to process should be used. For example, with a poly(ethylene terephthalate) having less than 10% crystallinity and poly lactic acid blend, the conditions suitable for reheat processing of the poly lactic acid should be used as it is the material most difficult to process.

Optional Materials

Optionally, other ingredients may be incorporated with the polymers. These optional ingredients may be present in quantities of about 50% or less, more typically from 0% or about 0.1% up to about 40%, and alternately up to about 30% by weight of the composition. The optional materials may be used to modify the processability and/or to modify physical properties such as elasticity, tensile strength and modulus of the final product. Other benefits include, but are not limited to, stability, flexibility, resiliency, workability, processing aids, viscosity modifiers, and odor control. Nonlimiting examples include salts, slip agents, crystallization accelerators or retarders, odor masking agents, emulsifiers, surfactants, plasticizers, lubricants, other processing aids, optical brighteners, antioxidants, flame retardants, dyes, pigments, fillers, waxes, tackifying resins, extenders, and mixtures thereof. Slip agents may be used to help reduce the tackiness or coefficient of friction in the fiber. A suitable slip agent is Erucamide E for polyethylene. Other additives used include a processing aid and other materials to modify physical properties such as elasticity, dry tensile strength, and wet strength of the extruded fibers.

Plasticizer and lubricant compounds can be used in the present invention. The plasticizers may improve the flexibility of the final products, which is believed to be due to the lowering of the glass transition temperature of the composition by the plasticizer. The plasticizer will typically have a molecular weight of less than about 100,000 g/mol and may be a block or random copolymer or terpolymer. Preferred plasticizers depend upon the material. For PET, dioctyl phthalate is typically used while for PLA, lactic acid or PEO can be used.

After the fiber is formed, the fiber may further be treated or the bonded fabric can be treated. A hydrophilic or hydrophobic finish can be added to adjust the surface energy and chemical nature of the fabric. For example, fibers that are hydrophobic may be treated with wetting agents to facilitate absorption of aqueous liquids. A bonded fabric can also be treated with a topical solution containing surfactants, pigments, slip agents, salt, or other materials to further adjust the surface properties of the fiber.

(4) Articles

The fibers and webs of the present invention may also be bonded or combined with other synthetic or natural fibers to make nonwoven articles. The synthetic or natural fibers may be blended together in the forming process or used in discrete layers. Suitable synthetic fibers include fibers made from polypropylene, polyethylene, polyester, polyamides, polyacrylates, and copolymers thereof and mixtures thereof. Natural fibers include cellulosic fibers and derivatives thereof. Suitable cellulosic fibers include those derived from any tree or vegetation, including hardwood fibers, softwood fibers, hemp, and cotton. Also included are fibers made from processed natural cellulosic resources such as rayon.

The fibers and webs of the present invention may be used to make nonwovens, among other suitable articles. Nonwoven articles are defined as articles that contain greater than 15% of a plurality of fibers that are continuous or non-continuous and physically and/or chemically attached to one another. The nonwoven may be combined with additional nonwovens or films to produce a layered product used either by itself or as a component in a complex combination of other materials, such as a baby diaper or feminine care pad. Preferred articles are disposable, nonwoven articles. The fibers and webs of the present invention may also be used to produce durable articles.

The resultant products may find use in filters for air, oil and water; vacuum cleaner filters; furnace filters; face masks; coffee filters, tea or coffee bags; thermal insulation materials and sound insulation materials; nonwovens for one-time use sanitary products such as diapers, feminine pads, and incontinence articles; biodegradable textile fabrics for improved moisture absorption and softness of wear such as micro fiber or breathable fabrics; an electrostatically charged, structured web for collecting and removing dust; reinforcements and webs for hard grades of paper, such as wrapping paper, writing paper, newsprint, corrugated paper board, and webs for tissue grades of paper such as toilet paper, paper towel, napkins and facial tissue; medical uses such as surgical drapes, wound dressing, bandages, dermal patches and self-dissolving sutures; and dental uses such as dental floss and toothbrush bristles. The fibrous web may also include odor absorbents, termite repellants, insecticides, rodenticides, and the like, for specific uses. The resultant product absorbs water and oil and may find use in oil or water spill clean-up, or controlled water retention and release for agricultural or horticultural applications.

EXAMPLES

The Examples below further illustrate the present invention.

Example A. A crystalline PLA was spun in a piston/cylinder one shot spinning system sold by Alex James Inc. of Greer SC. The spinnerette capillary was 0.016" diameter and has an L/D of 3. The extrusion rate was 0.8 g/min. The crystallinity was measured with Perkin Elmer DSC 7 at a heating rate of 20° C./min. The birefringence was measured using a Zeiss Axioskop microscope with a tilting compensator. The shrinkage was determined by measuring the length of a fiber before and after submersion in boiling water for 60 seconds. As table 1 indicates, increasing spinning speed increases crystallinity and birefringence while decreasing shrinkage.

TABLE 1

Microstructure and Properties of crystalline PLA

| Velocity m/min | $X_c$ % | Birefring. | Shrinkage % |
|---|---|---|---|
| 93 | 5 | 0.0024 | 55 |
| 572 | 8 | 0.0032 | 63 |
| 750 | 15 | 0.0052 | 58 |
| 933 | 15 | 0.0048 | 53 |
| 1438 | 17 | 0.0052 | 32 |
| 2743 | 20 | 0.0057 | 20 |

Example B. A reheat draw process was conducted on fibers made from crystalline PLA. The fibers were heated with 95° C. air in the jaws of the MTS 810 tensile frame. A hot air gun was mounted 2 inches from the sample and a diffusion screen of 100 mesh was located 0.5 inches from the sample. Table 2 illustrates that PLA fibers can be reheated and drawn to 100% strain when the fibers are spun at low speeds. The reheat draw becomes difficult as the fiber speed is increased.

TABLE 2

Survival of Fibers in High Speed Tensile 100% Strain at 2.4 m/s or a strain rate of 94 $s^{-1}$.

| Spinning Speed m/min | Temp C. | Strain % | Actual Speed m/s | Strain Rate/ s | Survived % |
|---|---|---|---|---|---|
| 880 | 73 | 100 | 2.4 | 94 | 100 |
| 1400 | 73 | 100 | 2.4 | 94 | 89 |
| 2100 | 73 | 100 | 2.4 | 94 | 0 |

Example C. Polyester fibers were spun at Hills Inc. on a 20 inch wide spun bond line. PET fibers made from Eastman F61FC resin were spun at three speeds. These fibers were i) drawn at room temperature to 100%, ii) annealed for 5 seconds with 160° C. air, or iii) annealed for 2 second with 160° C. air, drawn 10% relaxed 5%, cooled for 60 seconds then reheated for 1 second with 160° C. air and drawn 100%. The shrinkage, crystallinity, and survivability are shown in Table 3.

TABLE 3

Properties of PET fibers versus processing steps.

| Fiber | Fiber Samples | | | | | |
|---|---|---|---|---|---|---|
| | As-spun | | | Annealed Shrink- | | Annealed/ Drawn |
| Velocity m/min | Shrinkage (%) | $X_c$ (%) | Survival[1] (%) | age[2] (%) | $X_c$ (%) | Survival[3] (%) |
| 2600 | 74 | 16 | 89 | 0 | 33 | 89 |
| 3800 | 58 | 25 | 56 | 0 | 39 | |
| 4500 | 54 | 27 | 50 | 0 | 41 | |

Note:
[1]Percentage of fibers that survive a high-speed (2.5 m/s) tensile deformation to 100% strain at room
[2]Annealed for 5 seconds with 160 C. hot air
[3]Percentage of fibers that survive a high-speed (2.5 m/s) tensile deformation sequence of
a. Heated with 160 C. air for 2 seconds followed by 10% and −5% strain at high speed (2.5 m/s)
b. Cooled to room temperature for 60 seconds.
c. Heated with 160 C. air for 1 second followed by 100% strain at high speeds (2.5 m/s)

Example D. Fibers spun in example C where collected on a forming table having a belt speed of 90 n/min and thermally bonded with standard pass through calendar or bonded using the constrained bonding method. In both cases, the calendar roll temperatures are as indicated in Table 8. The effect of bonding method and bicomponent fiber constrainment is illustrated in Table 8. The webs are 25 gsm basis weight

TABLE 4

Web Formation Conditions and Widths of 16 segment Pie Fibers Calendered in Standard and Constrained Co-Bond/Quench Method.

| Material | Calender Temp (Top/Bottom in C) | Constrained Quench | Nom. Fiber Speed (m/min) | Web Width (Inch) |
|---|---|---|---|---|
| PET | 185/70 | No | 3000 | 7 |
| PET | 200/70 | Yes | 3000 | 18 |
| PET | 185/70 | No | 3800 | 11 |
| PET | 200/70 | Yes | 3800 | 19 |
| PE/PET (30/70) | 170/70 | No | 3000 | 14 |
| PE/PET (30/70) | 170/70 | Yes | 3000 | 21 |
| PE/PET (30/70) | 170/70 | Yes | 3800 | 21 |
| PE/PET (40/60) | 170/70 | Yes | 3800 | 21 |

Example E. The tensile properties of the webs produced in Example D are shown in Table 5. These webs were also post treated in ring rolling formation device. The resulting properties are also shown in Table 5. This data indicates ring rolling speed does not greatly affect properties. Monocomponent fibers exhibit a large loss in peak load. Alternate bonding/quenching methods can be used to increase the peak load. The bicomponent fiber chemistry significantly increases the peak load.

TABLE 5

Tensile Properties of As-Spun and Ring Rolled PET Webs

| | Test Direction | Post Treatment Speed (fpm) | Peak Load (gf) | Peak Elongation (%) |
|---|---|---|---|---|
| PET | MD | na | 840 | 100 |
| PET | CD | na | 740 | 90 |
| PET | CD | 200 | 59 | 159 |
| PET | CD | 500 | 47 | 194 |
| PET/PE (60/40 pie) | CD | na | 2515 | 125 |
| PET/PE (60/40 pie) | CD | na | 1310 | 133 |
| PET/PE (60/40 pie) | CD | 200 | 681 | 168 |
| PET/PE (60/40 pie) | CD | 500 | 468 | 184 |

The disclosures of all patents, patent applications (and any patents which issue thereon, as well as any corresponding published foreign patent applications), and publications mentioned throughout this description are hereby incorporated by reference herein. It is expressly not admitted, however, that any of the documents incorporated by reference herein teach or disclose the present invention.

While particular embodiments of the present invention have been illustrated and described, it would be obvious to those skilled in the art that various other changes and modifications can be made without departing from the spirit and scope of the invention. It is intended to cover in the appended claims all such changes and modifications that are within the scope of the invention.

What is claimed is:

1. An intermediate web comprising high glass transition polymer fibers, said fibers having a relative crystallinity of from about 10% to about 75% of the maximum achievable crystallinity, and said fibers being from 5 to 30 microns in diameter, wherein said web is capable of:

a. at least about 80% elongation at a strain rate of at least about 50 second$^{-1}$ and b. shrinkage of greater than 15%.

2. The web of claim 1 wherein the fibers are comprised of bicomponent cross sectional segments with a majority section comprised of a crystallizable high glass transition polymer having a maximum achievable absolute crystallinity of from about 15% to about 60%.

3. The web of claim 1 wherein the high glass transition polymer fibers comprise polyethylene terephthalate, polytrimethylene terephthalate, or poly lactic acid, or copolymers thereof, or combinations thereof, where the maximum achievable crystallinity of from about 15% to about 60%.

4. The web of claim 1 wherein the web is a spun bonded or a carded thermal point bonded web.

5. A laminate article comprising the web of claim 4.

6. A heat treated web comprising high glass transition polymer fibers, said fibers having a relative crystallinity of from about 10% to about 75% of the maximum achievable crystallinity, and said fibers being from 5 to 30 microns in diameter, wherein said web is capable of:

a. at least about 60% elongation at a strain rate of about and greater than 50 second$^{-1}$ and b. shrinkage of about 15% or less.

7. The web of claim 6 wherein the fibers are comprised of bicomponent cross sectional segments with a majority section comprised of a crystallizable high glass transition polymer having a maximum achievable absolute crystallinity of from about 15% to about 60%.

8. The web of claim 6 wherein the high glass transition polymer fibers comprise polyethylene terephthalate, polytrimethylene terephthalate, or poly lactic acid, or copolymers thereof, or combinations thereof, where the maximum achievable crystallinity of from about 15% to about 60%.

9. The web of claim 6 wherein the web is a spun bonded or a carded thermal point bonded web.

10. A laminate article comprising the web of claim 9.

11. A process for manufacturing a nonwoven web comprising a high glass transition temperature polymer, the process comprising the steps of:

a. spinning fibers having relative crystallinity of from about 10% to about 75% of the maximum achievable crystallinity, said fibers having a fiber shrinkage of about 30% or greater, b. thermally bonding the fibers using at least one calender roll heated above the glass transition temperature while the fibers are constrained; and c. quenching the fibers while constrained to produce a web having a web width of about 70% or greater of the prebonded web width.

12. The process according to claim 11 comprising the additional step of heat treating the web to reduce shrinkage to about 15% or less and relative crystallinity to about 60% or less of the maximum achievable crystallinity.

13. The process according to claim 12 wherein the heat treating step occurs after constrained bonding but before the quenching step, after the quenching step, during post-processing, or after post-processing.

14. The process for manufacturing either a spun bond or carded thermal point bonded web of claim 11 wherein the thermal bonding and quenching occur simultaneously.

15. The process for manufacturing a either a spun bond or carded thermal point bonded web of claim 11 further comprising the step of heat treating the web while the web is constrained with free spans between constraining devices that are about twelve inches or less.

16. A method for molding high glass transition polymers having relative crystallinity from about 10 to about 75% and shrinkage greater than 15%, wherein a web is constrained heated immediately prior to molding and the free span between constrained heating and molding is less than about fifteen inches.

17. The method of claim 16 wherein the molding is ring rolling or selfing.

18. The method of claim 16 wherein the web is constrained by using rolls or tentering frames.

19. The method according to claim 16 wherein segmental areas of the web are expanded by at least about 60% during molding.

20. A mechanically solid-state transformed web of high glass transition polymers wherein a final relative crystallinity is about 75% or greater and the web shrinkage is about 15% or less and wherein segments or the entire area of the web are increased in size by at least about 30% and the web is substantially free of damage.

21. The web of claim 20 wherein the high glass transition polymer fibers comprise polyethylene terephthalate, polytrimethylene terephthalate, or poly lactic acid, or copolymers threof, or combinations thereof, where the maximum achievable crystallinity is from about 15% to about 60%.

22. The web of claim 20 wherein the web is a spun bonded or a carded thermal point bonded web.

23. The web of claim 20 wherein fibers are comprised of bicomponent cross sectional segments with a majority section comprised of a crystallizable high glass transition polymer having a maximum achievable absolute crystallinity of from about 15% to about 60%.

24. A laminate article comprising the web of claim 20.

25. A web made by the method of of claim 11.

26. A web made by the method of claim 16.

* * * * *